United States Patent [19]

Bando et al.

[11] 4,437,078

[45] Mar. 13, 1984

[54] POLARIZED ELECTROMAGNETIC DEVICE

[75] Inventors: Yoshihide Bando, Kyoto; Toshiki Tanaka, Yawata; Sueaki Honda, Uji; Yoshihiko Takahashi, Kyoto; Kenichi Tsuruyoshi, Omihachiman; Katsumi Kawashima, Shiga; Syuichi Kishimoto, Kyoto, all of Japan

[73] Assignee: Omron Tateisi Electronics Co., Nagaokakyo, Japan

[21] Appl. No.: 263,495

[22] Filed: May 14, 1981

[30] Foreign Application Priority Data

| | | | |
|---|---|---|---|
| Feb. 3, 1981 | [JP] | Japan | 56-15229 |
| Mar. 3, 1981 | [JP] | Japan | 56-30764 |
| May 16, 1981 | [JP] | Japan | 56-65128 |

[51] Int. Cl.[3] ..... H01H 51/22

[52] U.S. Cl. ..... 335/81; 335/234

[58] Field of Search ..... 335/78, 80, 81, 229, 335/230, 234

[56] References Cited

U.S. PATENT DOCUMENTS

| | | | |
|---|---|---|---|
| 3,161,744 | 12/1964 | Thorne et al. | 335/81 |
| 3,525,958 | 8/1970 | Rauterberg | 335/82 X |
| 3,585,547 | 6/1971 | Sturman et al. | 335/230 X |
| 3,634,793 | 1/1972 | Sauer | 335/78 |
| 3,987,383 | 10/1976 | Antonitsch | 335/78 |
| 4,223,290 | 9/1980 | Agatahama et al. | 335/80 |
| 4,225,835 | 9/1980 | Vrsnak et al. | 335/78 |
| 4,329,672 | 5/1982 | Stahl et al. | 335/230 X |
| 4,342,016 | 7/1982 | Yokoo et al. | 335/79 |

*Primary Examiner*—George Harris

*Attorney, Agent, or Firm*—Wegner & Bretschneider

[57] ABSTRACT

A polarized electromagnetic device is disclosed having a generally I-shaped magnetic core member, a coil which is wound on the center portion of the core member, a pair of permanent magnets which are arranged in parallel with and outside of the respective end portions of the core member, and mutually confronting first and second armature plate members which are joined together through the pair of permanent magnets, with each magnet at the opposite end portions of the armature plate members in order to provide a spacing for accommodating the core member between the armature plate members, and consequently leaving a gap for relative movement therein. The core member and armature plate members are supported to be swingable relative to each other for movement about a center transverse axis of the center portion of the core member.

10 Claims, 11 Drawing Figures

POLARIZED ELECTROMAGNETIC DEVICE

BRIEF SUMMARY OF THE INVENTION

The present invention relates to a polarized electromagnetic device which includes a permanent magnet member, a core member wound with a coil and an armature member connected to the permanent magnet member to provide a swing movement in response to energization of the coil, and more particularly to an improved polarized electromagnetic device which is high in efficiency and small in size.

A polarized electromagnetic device is well known which includes a pair of parallel elongated armature plates which carry a permanent magnet block therebetween and are pivotally supported with respect to their centroidal axis extending perpendicularly to a centerline between the armature plates and a U-shaped core carrying a coil on its center portion and stationarily supported. The pole shoes of the core are respectively positioned between confronting free end portions of the armature plates outwardly extending beyond the sandwiched permanent magnet block so that the free end portions may swing across the respective pole shoes of the core. Such a conventional electromagnetic device, however, has the disadvantage that it is bulky and cannot produce a strong magnetic force with a small amount of electric power supply to the coil, because the core wound with the coil is disposed outwardly of the pair of armature plates and has a relatively long coil-pole shoe distance. This disadvantage is particularly undesirable in a compact polarized electromagnetic relay small in volumetric dimensions which is desirable for a precise switching operation with a small electric power supply.

It is, therefore, a primary object of the present invention to provide a polarized electromagnetic device which is easy to assemble, small in size, especially in thickness, and will perform an accurate swing operation with a reduced electric power supply.

It is a further object of the present invention to provide a polarized electromagnetic device which allows a magnetic field developed close to a permanent magnet source and that developed close to an electromagnet source to interact with a maximum efficiency.

It is another object of the present invention to provide a polarized electromagnetic device which includes a stationary core wound with a coil and a pair of swingably supported armature plates which are joined together each other through a pair of permanent magnets and accomodate the stationary core therein.

It is still another object of the present invention to provide an accurate polarized electromagnetic device which includes a polarized electromagnetic block having stationary and swingable members and a contact block carrying a contact mechanism actuated by the swingable member.

Other objects and advantages of the present invention will be apparent upon reference to the following description in conjunction with accompanying drawings, in which:

DETAILED DESCRIPTION

Figure 1:
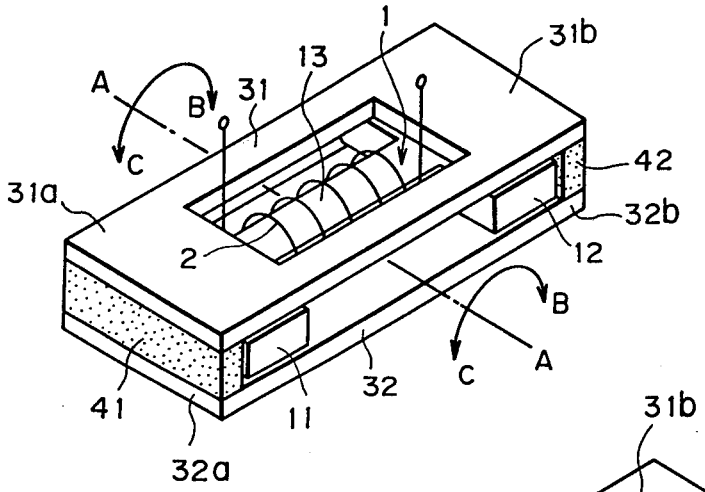
FIG. 1 is a perspective view of a polarized electromagnetic device of a latch type as a preferred embodiment of the present invention.
Figure 2:
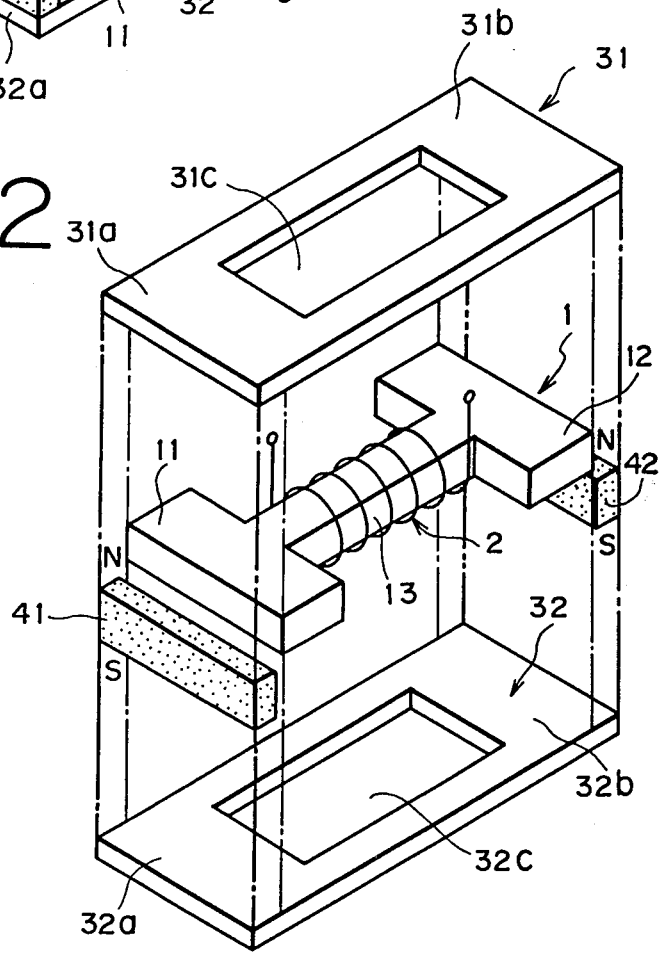
FIG. 2 is a disassembled view showing the device of FIG. 1.

Referring, now, to FIGS. 1 and 2 there is shown a polarized electromagnetic device as a preferred embodiment of the present invention. The electromagnetic device includes a generally I-shaped or H-shaped core 1, a coil 2 wound on a center portion 13 of the core 1, a pair of permanent magnets 41 and 42 which are arranged in parallel with and outside of the respective end portions (pole shoes) 11 and 12 of the core 1, and first (upper) and second (lower) armature plate members 31 and 32 which are joined together through the magnets 41 and 42 and adapted to provide a chamber for accommodating the core 1 therebetween, and leaving a gap between the core 1 and the armature plate member/permanent magnet assembly. The I-shaped core 1 is made from magnetic plate by stamping. The armatures 31 and 32 are made from magnetic plate by stamping as shown in FIG. 2, and have portions 31*a*,31*b*,32*a*, and 32*b* all of which are substantially the same in size. Each of the armatures 31 and 32 is formed in the shape of a flat picture frame having a central opening (31*c* or 32*c*) for accommodating a projecting portion of the coil 2 from the center portion 13, whereby the entire thickness of the device of FIG. 1 may be decreased. Alternatively, the armatures 31 and 32 may be formed in the shape of solid flat plate having no opening if desired. The respective permanent magnets 41 and 42 are arranged in the same direction. In this embodiment, the magnets 41 and 42 are arranged in such a manner that their respective top surfaces are N-magnetic pole. The core 1 with coil 2 is stationarily supported by a non-magnetic member (not shown in drawings). In FIG. 1, the armature plates 31 and 32 and the magnets 41 and 42 are carried by a non-magnetic member (not shown in drawings) and are supported to be swingable with respect to a transverse center line A—A perpendicular to the longitudinal axis of the center portion 13 as shown in arrow marks (B—C).

Figure 3A:
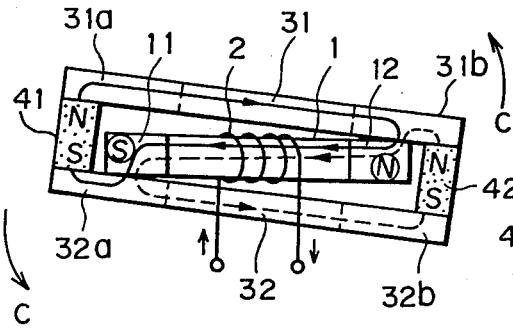
FIGS. 3A and 3B show schematic front views illustrating operations of the device of FIG. 1.

Operations of the device of FIG. 1 will now be described referring to FIGS. 3A and 3B. Assume that the armatures 31 and 32 have been in the position as shown in FIG. 3A by a former energization of coil 2. Then, magnetic lines emitted from magnets 41 and 42 flow as shown in arrow marked flow lines, whereby the respective end portions 11 and 12 of core 1 are attracted by the respective attracting portions 32*a* and 32*b*. Upon energizing the coil 2 so as to polarize portion 11 to S-pole and portion 12 to N-pole, the portions 31*b* and 32*a* respectively repel the end portions 12 and 11, while portions 32*b* and 31*a* respectively attract the portions 12 and 11. Then, the armatures 31 and 32 swing in the direction shown in arrow marks C so as to take a position shown in FIG. 3B. Even if the coil 2 is de-energized after moving the armatures to the position of FIG. 3B, magnetic lines emitted from magnets 41 and 42 flow as shown in FIG. 3B and the armatures 41 and 42 keep the position.

Figure 3B:
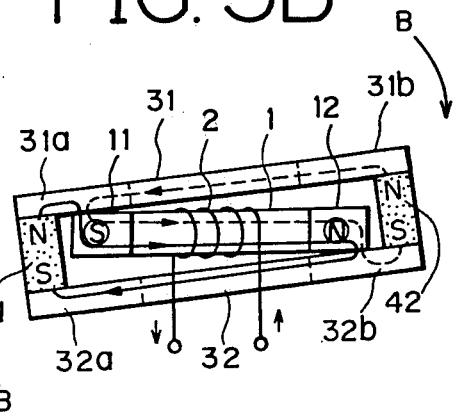

In FIG. 3B, if a reverse current is applied to the coil 2 in the direction illustrated by arrow marks to as to reversely polarize both end portions 11 and 12, the attracted portions 31*a* and 32*b* are set to be repelled, while the repelled portions 32*a* and 31*b* are set to be attracted. Then the armatures 31 and 32 swing clockwise as illustrated by arrow marks B, and return to the original position of FIG. 3A. By changing the direction of current flowing through the coil 2, the armatures 31 and 32 are set to the position of FIG. 3A or FIG. 3B. The armatures also keep their position without application of electricity until the coil 2 is supplied with a current having an opposite direction. Thus, the polarized electromagnetic device of this embodiment provides latching-operations. If desired, the electromagnetic device may be modified in such a manner that the coil 2 consists a pair of coils, which are oppositely wound on the center portion 13 of core 1, and the core 1 is reversely magnetized by selectively energizing one of the coils.

Figure 4:
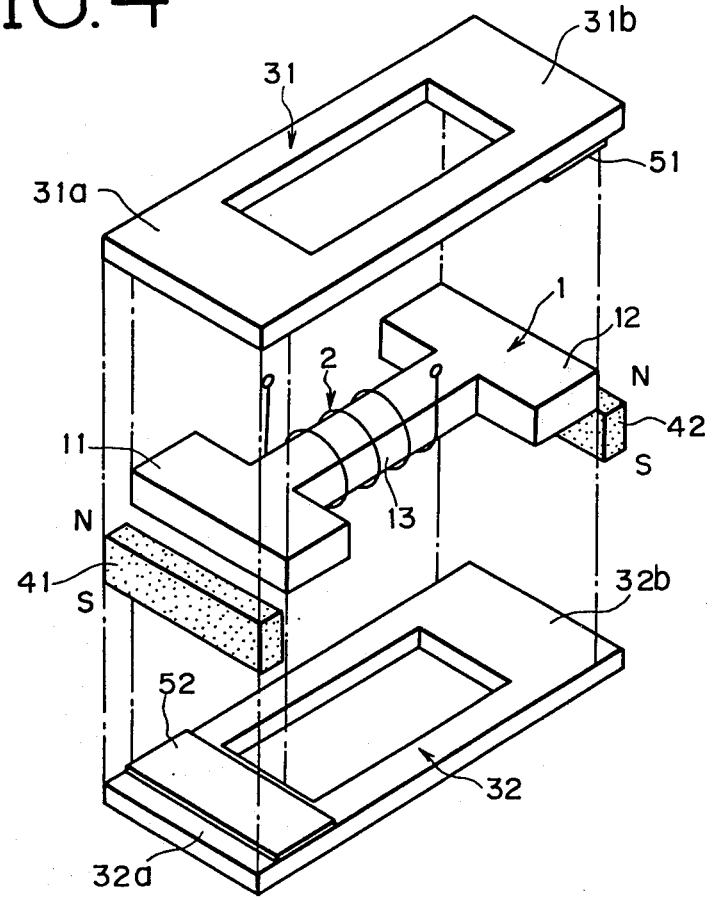
FIG. 4 is a disassembled view showing a polarized electromagnetic device of a single stable type as a modification of the embodiment of FIG. 1.

In FIG. 4, there is shown a polarized electromagnetic device of a single-stable type as a modification of the foregoing embodiment. A pair of spacers 51 and 52 made of nonmagnetic material are respectively fixed to the portions 31*b* and 32*a* which are attracted by excited core 1. During de-energization of the coil 2, attracting forces produced from portions 31*b* and 32*a* are smaller than those from portions 32*b* and 31*a* with respect to end portions 12 and 11, respectively. Therefore, the end portions 11 and 12 are normally attracted by the portions 31*a* and 32*b*. When the coil 2 is energized so as to polarize the portions 11 and 12 to S and N poles, they attract the portions 31*a* and 32*b*. Alternatively, the spacers 51 and 52 may be fixed to the corresponding surfaces of end portions 11 and 12 in place of those of armatures 31 and 32, if desired.

Figure 5:
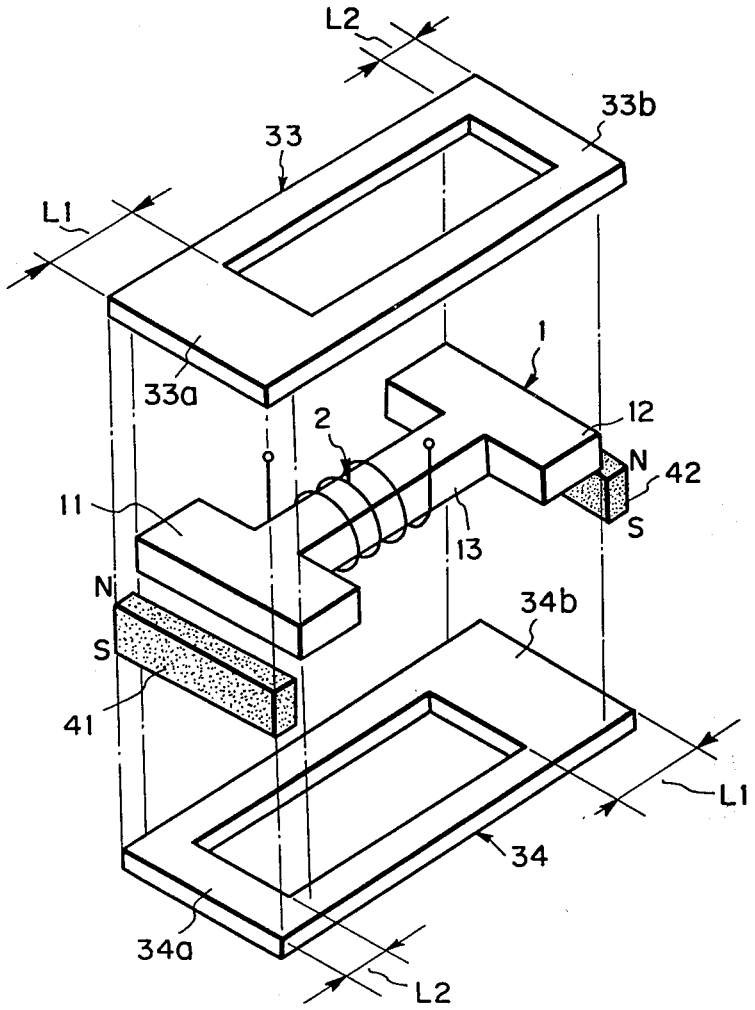
FIG. 5 is a disassembled view showing a polarized electromagnetic device of a single stable type as another modification of the embodiment of FIG. 1.

In FIG. 5 there is shown a polarized electromagnetic device as a modification of the embodiment of FIG. 4. Portions 33*a* and 34*b* of a pair of coupled armatures 33 and 34 are respectively formed to be broader than their opposite portions 33*b* and 34*a* ($L1 > L2$), whereby end portions 11 and 12 are normally attracted by the respectively confronting portions 33*a* and 34*b* so as to contact therewith. When the coil 2 is energized so as to polarize the respective portions 11 and 12 to N and S poles, the end portions 11 and 12 respectively repel the portions 33*a* and 34*b*, and come into contact with the respectively opposed portions 34*a* and 33*b*. When the coil 2 is de-energized, the end portions 11 and 12 are again attracted by the respective portions 33*a* and 34*b*, and the armatures 33 and 34 return to their original position. Thus, a single-stable operation is performed without a spring.

Since the polarized electromagnetic devices according to the foregoing embodiments have such a construction that a pair of armatures in the shape of plates are joined together through a pair of permanent magnets to accommodate a core wound with a coil in the direction across the pair of permanent magnets, the magnetic forces developed from both pole shoes (11 and 12) of the core effectively act with those from the permanent magnets for attracting or repelling operations and its electric power consumption is reduced. The permanent magnets are disposed outside of both end portions of the core at the edges of the armatures, whereby the volumetric size of the permanent magnets may be freely designed irrelevant to the shape and size of the core and, also, the sensitivity of the device may be freely designed. The polarized electromagnetic device is of a stacked-up construction consisting of flat-shaped components, viz. core and armatures, so that it is small in size, especially in height.

Figure 6:
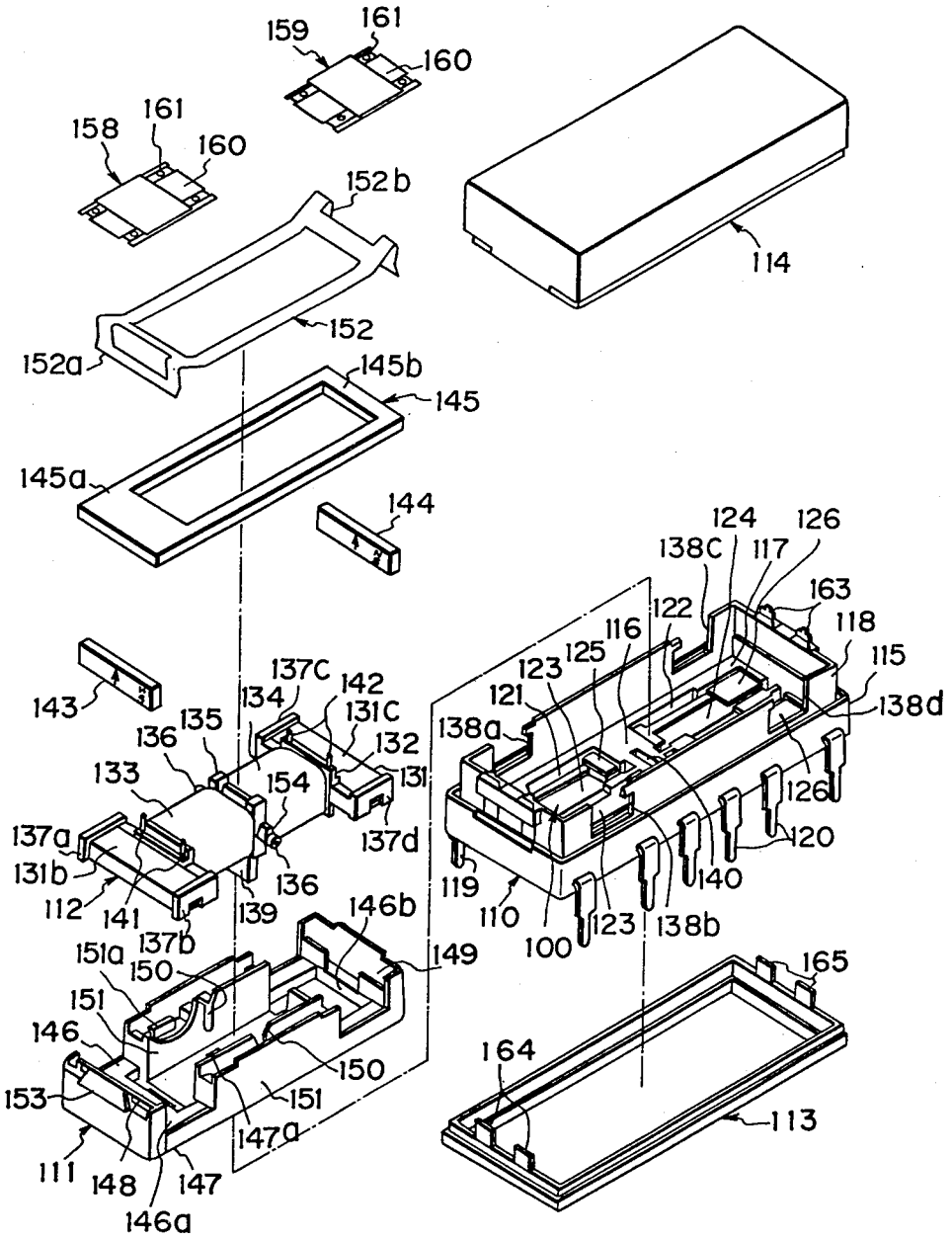
FIG. 6 is a perspective disassembled view of a polarized electromagnetic device as another embodiment of the present invention.
Figure 7:
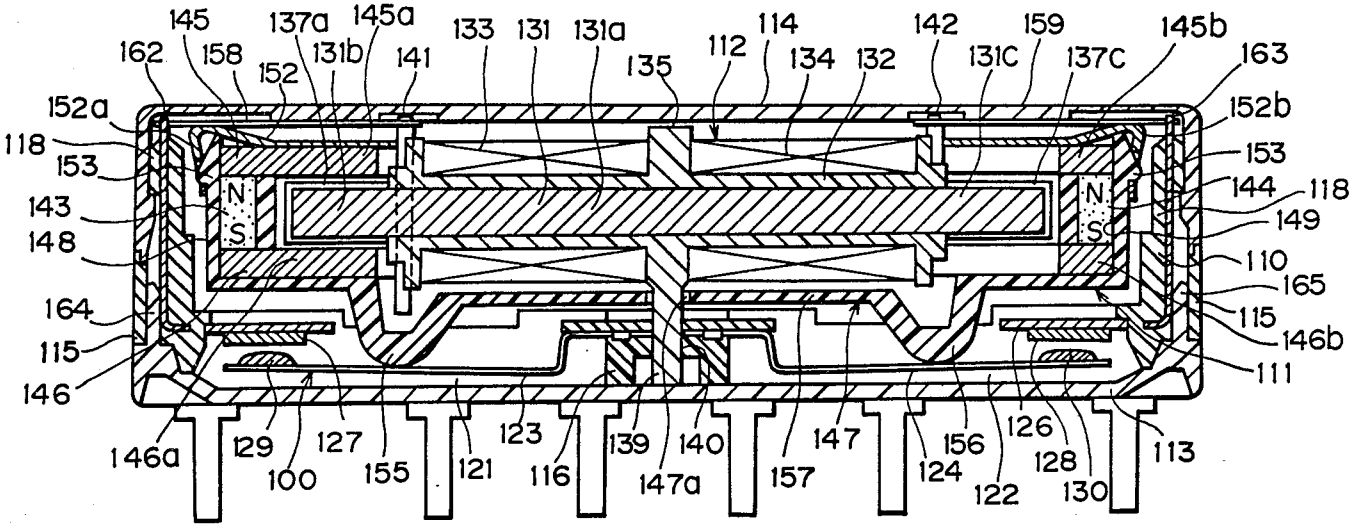
FIG. 7 is a front assembled sectional view showing the device of FIG. 6.

Refering to FIG. 6, there is shown a latch type polarized electromagnetic device further including a contact switching mechanism, viz. relay, which is semi-assembled as another embodiment of the present invention. The electromagnetic device includes a box-shaped base member 110, a movable member 111 swingably mounted on the base member 110, a electromagnetic member 112 fixed to the base member 110, a lower cover 113 fitted onto a lower surface of the base member 110, and an upper cover 114 which is adapted to contact the periphery of the base member 110. FIG. 7 illustrates the electromagnetic device of FIG. 6 in completely assembled form.

The base member 110 is an insert-molded plastic including a frame portion 115, a bottom portion 117 having a center separating wall 116 extending downwardly therefrom, a peripheral wall 118 standing on the periphery of the bottom portion 117. The base member 110 further carries a plurality of external terminal pairs 119 and 120 which are arranged in parallel fashion and spaced-apart on side portions of the base member 110.

In the bottom portion 117 there are provided openings 121 and 122 on both sides of the separating wall 116. Movable contact blades 123 and 124 are at their base portions fixed to the wall 116, and disposed in the openings 121 and 122. On free ends of the blades 123 and 124 there are contact points 129 and 130 which confront stationary contacts 127 and 128 of stationary contact blades 125 and 126, respectively. Thus, there, is constructed a contact mechanism 100.

The electromagnetic member 112 includes an I-shaped core 131, a spool 132 which is an insert-molded plastic carrying the core 131, and a pair of coils 133 and 134. The core 131 is made from a magnetic plate to be of an I-shape, and consists of a center portion 131*a* and end portions (pole shoes) 131*b* and 131*c*. The coils 133 and 134 are wound, in a mutually opposite relation on the center portion 131*a* of core 131 through spool 132. The spool 132 at its center forms a separating wall 135 for insulating the coils 133 and 134 from each other, and further forms a pair of stub shafts 136 extending outwardly in the direction perpendicular to the longitudinal axis of the core 131. The electromagnetic member 112 is adapted to be supported by the peripheral wall 118 in such a manner that shoulder portions 137*a* to 137*d* of the spool 132 are engaged with four cut-out portions 138*a* to 138*d* formed in the wall 118, respectively. A projection 139 extending downwardly from the separating wall 135 is inserted into a center opening 140 of the base member 110 so as to secure the electromagnet member 112 in position. There are inserted coil terminals 141 and 142 in flange portions of the spool 132 for connection with wires of coils 133 and 134.

Upper and lower armatures 145 and 146 are made from a magnetic plate by stamping and have similar shapes to those of armatures 33 and 34 of FIG. 5. In this embodiment, however, the armatures 145 and 146 are arranged in parallel and in the same direction as each other in order to perform latching operations. The respective broad and narrow portions 145*a* and 145*b* are arranged to oppose the respective broad and narrow portion 146*a* and 146*b*. The armature 145 and 146 are adapted to be joined together through a pair of permanent magnets 143 and 144 in order to sandwich the core 131 therebetween. An insert-molded plastic matrix 147 carries the lower armature 146, and forms a pair of compartments 148 and 149. The permanent magnets 143 and 144 are respectively inserted into the compartments 148 and 149 in such a manner that their upper portions are N-poles and they reside outside of the end portions 131*b* and 131*c* of the core.

Figure 8:
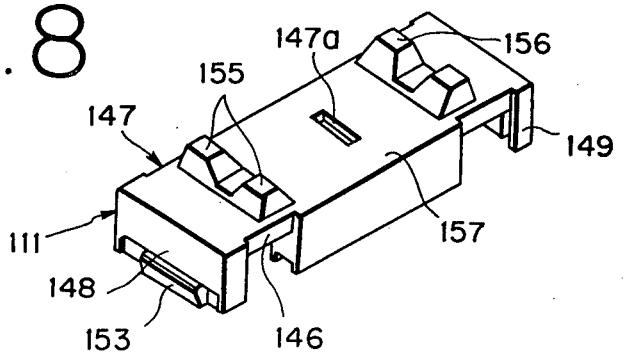
FIG. 8 is a perspective view showing an insert-molded matrix carrying a lower armature plate which is employed in the device of FIG. 6 as viewed from the bottom side.

The insulating matrix 147 has a pair of U-shaped grooves 150 formed in side wall portions 151 which are adapted to be engaged with the pair of shafts 136, and the matrix 147 also has a central opening 147*a* through which the projection 139 extends downwardly. As illustrated in FIGS. 7 and 8, the matrix 147 forms, on its bottom wall 157, two pairs of projections 155 and 156 for actuating the movable blades 123 and 124. The bottom wall 157 serves as an insulator between the contact mechanism 100 and coils (133 and 134).

The upper armature 145 is mounted on the insulating matrix 147 that carries magnets 143 and 144.

Then, a biasing leaf spring 152 is engaged at its end portions 152*a* and 152*b* with a pair of projections 153 so as to secure the armature 145 to the matrix 147. The armature 145 on its bottom surface is pressed to top surfaces of a pair of trapezoid portions above shafts 136 so as to ensure such engagement between the matrix 147 and the member 112. The armature 145 further come into contact with four islands 151*a* formed in the side wall portions 151.

Thus, the movable member 111 consisting of matrix 147, magnets 143 and 144, armature 145 and spring 152 is swingably supported by the shafts 136 of the electromagnet member 112 enclosed therein, and the member 112 is fixed to the base member 110. The coil terminals 141 and 142 are connected to terminals 162 and 163 through connection plates 158 and 159 in which a conductive pattern 161 is disposed on an insulating film 60.

The upper cover 114 is fitted onto the frame portion 115. The lower cover 113 is fitted onto the base member 110 by inserting a pair of upwardly extending projections 164 and 165 into slits between portions 115 and 118.

Operations of the device in this embodiment are substantially the same as those of the device of FIG. 1. The core 131, magnets 143 and 144, and armatures 145 and 146 in FIG. 7 correspond to the core 1, magnets 41 and 42, and armatures 31 and 32. In FIG. 7, when the coil 133 is energized so as to polarize the core 131 to S-pole at portion 131*b* and N-pole at portion 131*c*, the movable member 111 having the armatures 145 and 146 swings counterclockwise so as to open the contacts 127 and 129 and close the contacts 128 and 130, and keep its position even after de-energizing the coil 133. When the coil 134 is energized so as to polarize the core 131 to a reverse direction, the movable member 111 swings clockwise so as to close the contacts 127 and 129 and open the contacts 128 and 130, and keep its position even after de-energization. Thus, latching operations are performed.

According to this embodiment, the movable member 111 is swingably supported by the pair of shafts 136, whereby, irrespective of any errors of scale in molding the base member 110, the members 110 and 111 are brought into an accurate relationship and the opertional characteristics are stabilized. Since the shafts 136 and spool 132 are molded as a single unit, the assembling work for this device is simplified. The device in this embodiment has good electrical insulation without any additional components, because the bottom wall 157 of the matrix 147 completely insulates the electromagnet portion and the contact mechanism.

The polarized electromagnetic device in this embodiment may be modified in such a manner that a single coil is wound on the core 131 as illustrated in FIG. 2 or the movable member 111 has a single-stable construction as illustrated in FIG. 4 or 5. It should be understood that by simply mounting the upper armature 145 in a reverse direction, the construction is changed to a single stable type. In FIG. 6, adhesive materials may be applied to the respective top surfaces of the four island portions 151*a* so as to joint the upper armature 145 to the matrix 147, whereby the spring 152 may be omitted. Since the respective island portions 151*a* are surrounded with grooves, the adhesives materials forced out from the island portions 151*a* by contacting the armature 145 therewith fall into the gooves, whereby perfect movement of the movable member is retained.

Figure 9:
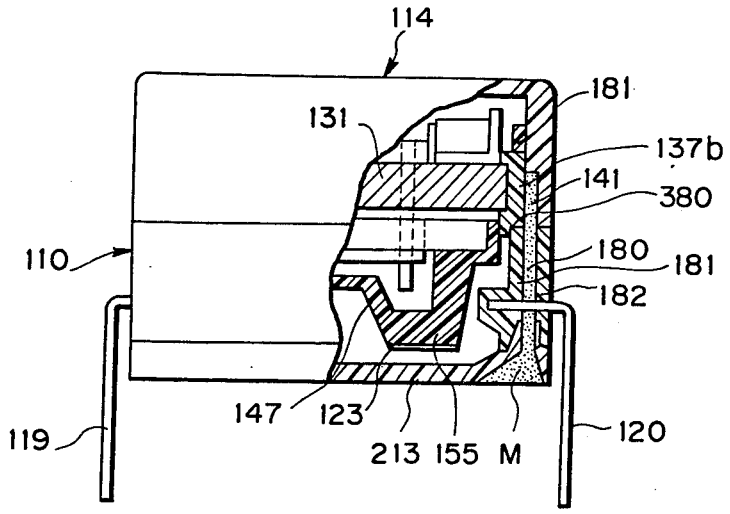
FIG. 9 is a partial cutaway side view showing a polarized electromagnetic device as a modification of the embodiment of FIG. 6.
Figure 10:
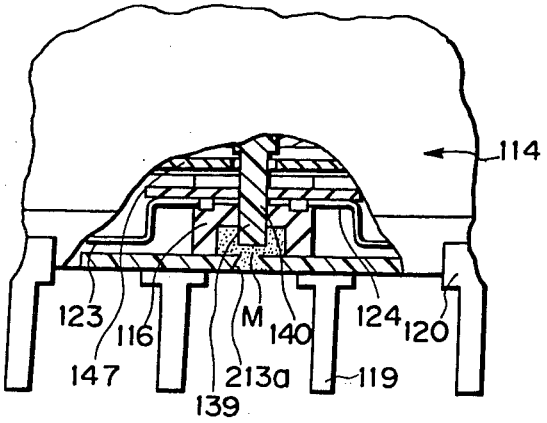
FIG. 10 is a partial cutaway fragmentary front view showing the device of FIG. 9.

In FIGS. 9 and 10, there is shown a polarized electromagnetic device as another modification of the embodiment of FIG. 6. The base member 110 of FIG. 6 is modified to have a double-wall lateral structure which consists of an inner wall 181 (corresponding to peripheral wall 118) and an outer wall 182 (corresponding to frame portion 115) so as to form an elongated opening 180 extending vertically through the entire thickness of the base member. The inner wall 181 forms four window openings 380 (corresponding to the cut portions 138*a* to 138*d* of FIG. 6) which are adapted to receive the shoulder portions 137*a* to 137*d* in order to fix the core 131 in position. The upper cover 114 of FIG. 6 is modified here to have at its lower end portion a recessed portion 141. The lower cover 113 of FIG. 6 is modified as illustrated in FIGS. 9 and 10. The lower cover 213 is adapted to be fitted to the inner wall 181 and includes a center opening 213*a* under the projection 139. Thus, when the device is completely assembled as shown in FIG. 9, a sealant M is filled into the opening 180 and slit 141 to thereby seal and secure in position the connecting terminals (119, 120), lower cover 213, base member 110, shoulder portions (137*a* to 137*d*) and upper cover 114. The gases evolved from the sealant M within the device on curing are evacuated through the opening 213*a*. Then, the opening 213*a* is filled with a sealant M to complete sealing operation as illustrated in FIG. 10. In this embodiment a plurality of ribs (not shown in drawings) are interposed between inner and outer walls 181 and 182 so as to unite them.

Though in the foregoing embodiments the electromagnet (1) is stationarily supported and the armatures (31 and 32) are swingably supported, they may be reversely supported in such a manner that the electromagnet with its associated members is swingably supported and the armatures are stationarily supported.

It should be understood that the above description is merely illustrative of the present invention and that many changes and modifications may be made by those skilled in the art without departing from the scope of the appended claims.

What is claimed is:

1. A polarized electromagnetic device, comprising:

a generally I-shaped magnetic core member carrying a coil winding on the central portion thereof;

a pair of permanent magnets which are arranged in parallel with and outwardly of the respective end portions of said core member; and first and second armature plate members which are mutually confronting and joined together through said pair of permanent magnets at the opposite end portions of said armature plate members, thereby presenting a spacing for accommodating said core member therebetween with gaps between said plate members and said core member;

said core member and armature plate members being supported to be swingable for relative movement with respect to a center transverse axis of said center portion of the core member.

2. A polarized electromagnetic device according to claim 1, wherein said core member is stationarily supported and said armature plate members are pivotally supported in order to allow the respective end portions of said core member of alternately attract and contact an inner wall surface of said armature plate members.

3. A polarized electromagnetic device according to claim 1, wherein each of said armature plate members is provided with an opening to accommodate said wound coil.

4. A polarized electromagnetic device according to claim 1 further comprising a pair of non-magnetic spacers, disposed in a pair of gaps between said plate members and said core members, through which the respective end portions of said core member attract their confronting portions of said armature plate members upon energization of said coil.

5. A polarized electromagnetic device according to claim 3, wherein each of said armature plate members has a first end portion and a second end portion said first portion being broader than said second portion in size.

6. A polarized electromagnetic device according to claim 1 which further comprises a contact carrying member including a base made of electrically insulating material and a contact mechanism and means for actuating said contract mechanism in response to the swing movement of said core member or said armature plate members.

7. A polarized electromagnetic device according to claim 6, wherein said core is stationarily supported by said base, and said actuating means is a pivotally supported matrix member which carries said armature plate members and includes at least one projection for actuating said contact mechanism.

8. A polarized electromagnetic device according to claim 7, wherein said matrix member includes an insulating wall for separating said contact mechanism from said core member wound with the coil.

9. A polarized electromagnetic device according to claim 7, wherein said matrix member is an insert-molded plastic matrix carrying said second armature plate member and at its periphery includes an island surrounded with a groove so as to adhere said first armature plate member to a top surface of said island with an adhesive material.

10. A polarized electromagnetic device according to claim 7, wherein said base comprises inner and outer walls which therebetween form an opening extending vertically through the entire thickness of the base adapted to be filled with a sealant from the bottom side thereof to thereby seal and secure in position said base, said core member engaged with said base and a cover fitted onto said base.

* * * * *